US006078343A

United States Patent [19]

Jordan

[11] Patent Number: 6,078,343

[45] Date of Patent: Jun. 20, 2000

[54] AUTOMATIC VARIABLE SPEED PRINT APPARATUS AND METHOD

[75] Inventor: James M. Jordan, Eagan, Minn.

[73] Assignee: Datacard Corporation, Minneapolis, Minn.

[21] Appl. No.: 08/797,181

[22] Filed: Feb. 10, 1997

[51] Int. Cl.[7] ..... B41J 11/42

[52] U.S. Cl. ..... 347/188; 347/183

[58] Field of Search ..... 347/188, 211, 347/183, 184, 16; 358/298; 395/111

[56] References Cited

U.S. PATENT DOCUMENTS 5,099,258 3/1992 Hirayama ..... 347/188
5,400,059 3/1995 Kwon ..... 347/184
5,584,589 12/1996 Adkins et al. ..... 400/584
5,585,834 12/1996 Nagano ..... 347/211
5,629,730 5/1997 Park ..... 347/188

*Primary Examiner*—N. Le
*Assistant Examiner*—Anh T. N. Vo
*Attorney, Agent, or Firm*—Merchant & Gould P.C.

[57] ABSTRACT

A variable speed print apparatus and method provide for adjustment of the effective print speed for each print line being printed on the work piece by determining a maximum shade value to be printed on each print line and adjusting the print speed for each line accordingly. When there is no printing on a given line of the work piece, that print line may be effectively skipped altogether.

8 Claims, 1 Drawing Sheet

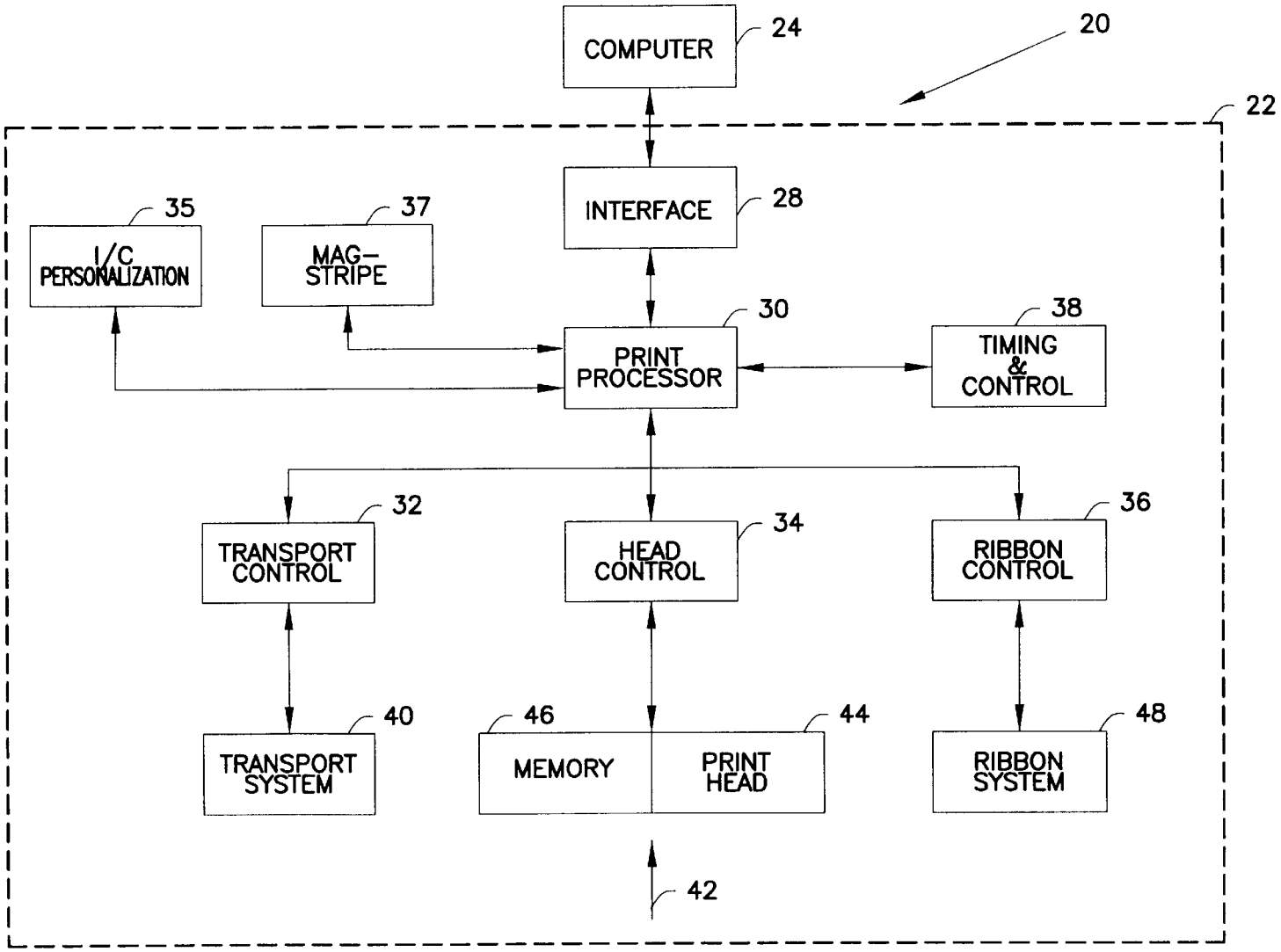
20
22
24
COMPUTER
28
INTERFACE
30
PRINT PROCESSOR
38
TIMING & CONTROL
36
RIBBON CONTROL
48
RIBBON SYSTEM
34
HEAD CONTROL
44
PRINT HEAD
42
46
MEMORY
37
MAG-STRIPE
35
I/C PERSONALIZATION
32
TRANSPORT CONTROL
40
TRANSPORT SYSTEM

AUTOMATIC VARIABLE SPEED PRINT APPARATUS AND METHOD

BACKGROUND OF THE INVENTION

The present invention relates to a print apparatus and method for printing at a variable print speed.

Thermal printers are often used to print color images on work pieces such as plastic cards. A color image is created on a work piece by making multiple printing passes over the work piece with the printer printing a basic color, also referred to as a color canvas, on each pass so as to derive a composite color image once each color canvas has been printed. The three basic colors typically used are yellow, magenta, and cyan. Color data is sent to the printer for each pixel to be printed. This data might be sent in vary sizes, e.g., 4-bit, 8-bit, 16-bit, etc.

If 8-bit color data is used for each basic color, i.e., each pixel printed on the work piece has a shade value from 0–255 with 0 representing none of the basic color or zero optical density for a given pixel and 255 representing the maximum transfer of dye to the work piece or maximum optical density for a given pixel. It is often said that the data value of 0–255 represents the color shade or optical density of the color. Thus, if 8-bit color data is being used, there are 256 possible different shade values or optical densities for each basic color. By doing three different basic color passes so as to combine the three basic colors to create a composite color, a combination of more than sixteen million colors ($256^3$) can be obtained for each pixel location on the work piece.

As noted above each basic color printed on the printer is referred to as a color canvas. Even though there might be 256 color shades available for each color canvas (as in the example of 8-bit color data), it is quite possible that the maximum shade value or optical density which is used or present in a given color canvas is less than the maximum possible data shade value. For example, the maximum shade value used in a given color canvas might be 100 whereas the maximum possible data shade value is 255 (where 8-bit color data is used).

Most thermal printers are limited in the number of color shades they can print. For example, a printer may only be able to print 128 different color shades even though 8-bit color data is being received for each color. Typically, a thermal printer has individual printer dot elements which are energized a varying number of times and/or length of time for each pixel of the color image to be printed depending on the shade value to be printed at that pixel. Typically this is done under control of a clock such that the printer dot elements are energized for the number of clock cycles necessary to print the shade value at each pixel. Most printers have an upper limit on the number of clock cycles per pixel or the number of times their printer dot elements can be energized per pixel which accordingly limits the number of color shades they can print.

Traditionally thermal transfer printing is done at a fixed speed as determined by either the media (receptor absorption rate) or the ribbon's dye transfer speed, and the rate at which data could be clocked out to the print head. Printers are designed to print at the worst case speed. Thus the printer must wait the entire time it would take to energize the printer dot elements to print all of the pixels on a color canvas as though they were at the maximum shade value. Although the receptor absorption rate and the dye transfer speeds define the absolute high end print speeds, there is substantial waste in efficiency by the printer having to print at the worst case speed.

The present invention solves these problems and other problems associated with existing printing apparatus and methods.

SUMMARY OF THE INVENTION

The present invention relates to a thermal printer apparatus and method for printing at variable speeds.

In one embodiment, the invention relates to a variable speed print apparatus, including a thermal printer, and a control processor operatively interconnected to the thermal printer controlling the print rate of the thermal printer generally in accordance with the following algorithm:

$$\text{Print Rate}=\text{tpreheat shades}+(\text{nshades} * \text{tper shade})+K$$

where:

tpreheat shades=time for preheat cycles;

nshades=maximum number of possible color shades for the current color canvas;

tper shade=time per print shade (clock rate); and

K=overhead time processing constant.

In a preferred embodiment, the print rate is adjusted for each color canvas per work piece being printed on.

In yet another preferred embodiment, the print rate is adjusted for each color canvas per print line.

The present invention, in addition to other advantages, allows for he automatic adjustment of the print rate so as to increase overall print speed.

In a preferred embodiment of the present invention, the maximum umber of shade values within a given color canvas will be normalized to configured maximum shade value based on the maximum number of shades which the printer is configured to print.

These and various other advantages and features of novelty which characterize the invention are pointed out with particularity in the claims annexed hereto and forming a part hereof. However, for a better understanding of the invention, its advantages, and the objects obtained by its use, reference should be made to the accompanying drawings and descriptive matter, which form a further part hereof, and in which there is illustrated and described a preferred embodiment of the invention.

BRIEF DESCRIPTION OF THE DRAWINGS

In the drawings wherein corresponding reference numerals generally indicate corresponding parts throughout the several views;

FIG. 1 is a block diagram of an embodiment of the invention.

DETAILED DESCRIPTION OF A PREFERRED EMBODIMENT

In a preferred embodiment, a print apparatus and method is used in accordance with the principles of the present invention which calculates and adjusts the print speed to its optimal print rate based on the data being printed for each basic color (Yellow, Magenta, Cyan or Monochromatic), also referred to as a color canvas, on a given work piece having indicia printed thereon. Given enough resolution and a quick responding system, the print apparatus and method of the present invention might also allow for adjustment of its speed for each print line being printed on the work piece by determining the maximum shade value to be printed on each print line and adjusting the print rate for each line accordingly. The print apparatus and method of the present invention also provides the option, that if there is no printing on a given line of the work piece, e.g., if no printer elements or dots are on for a given print line, that print line may be effectively skipped altogether. Preferably, the time between line printing will not be less than a time value constant of K, which is the time required by the print apparatus and method to set up and prepare the next print line (the value K is often referred to as the overhead processing time constant). It will be appreciated that K will vary depending on the particular print apparatus being used.

FIG. 1 is a block diagram illustrating a thermal printer 20 constructed in accordance with the principles of the present invention. Generally, the thermal printer 20 includes a print engine 22 for printing graphic images on receptor substrates, and a host computer 24 for providing the graphic images to the print engine 22. Data and commands are delivered between the print engine 22 and the computer 24 by an interface 28.

The print engine 22 includes a print processor 30 that controls the overall operation of the print engine 22. The print processor 30 interfaces with a transport controller 32, a head controller 34, and a ribbon controller 36. A timing and control processor 38 cooperates with the print processor 30 to coordinate and synchronize the operation of the transport controller 32, the head controller 34 and the ribbon controller 36. The print engine 22 also optionally includes an integrated circuit personalization interface 35 and a magnetic stripe personalization interface 37.

Through the transport controller 32, the print processor 30 controls a transport system 40 for moving substrates, such as cards, through the system. The transport system 40 preferably includes an arrangement of guide ramps, feed rollers, sensors, and stepper motors. The progress of a substrate through the system is monitored and controlled by the transport controller 32 via stepper motor signals and sensor signals from the transport system 40. Through the ribbon controller 36, the print processor 30 also controls a ribbon system 48 that includes a thermal transfer ribbon for transferring thermally reactive ink or dye to a given substrate such as a card.

The print engine 22 also includes a print module 42 having a thermal print head 44 and a source of non-volatile memory 46 such as a printed circuit board mounted adjacent to the print head 44. The print head 44 and the source of non-volatile memory 46 preferably comprise a package or module that can easily be removed from the system and replaced with a different package or module. The print head 44 preferably includes a row or column of dot elements. In one embodiment, the print head 44 includes 671 dot elements. The dot elements are resistive elements that, when activated, heat a transfer ribbon which causes a thermally reactive ink or dye to be transferred from a carrier ribbon to a desired location on a substrate. The operation of the print head 44 is controlled by print processor 30 through the head controller 34.

In one embodiment, the print processor 30 includes programmed logic to automatically adjust the print rate of the print head 44 as follows:

$$\text{Print Rate}=\text{tpreheat shades}+(\text{nshades} * \text{tper shade})+K$$

where:

tpreheat shades=time for preheat cycles;

nshades=the maximum number of possible color shades for the current color canvas;

tper shade=time per print shade (clock rate); and

K=overhead time processing constant.

The time for the preheat cycles, tpreheat shades, is the time it takes to preheat the printer prior to initiating printing of each column of pixels to be printed. Preheat cycles are used to ensure the print head is near the temperature required to transfer dye. This is done once at the beginning of each print column. The preheat value specifies the number of times (cycles or strobes) to energize the print head at 100% duty cycle. In a preferred embodiment of the invention, the preheat cycles range from 0–31 max. The number of columns will vary depending on the size of the work piece, the resolution of the printer, etc. For example, when printing at 300 dots per inch (dpi), each column is 1/300 inch wide. If the printing area of the work piece is four inches then 1200 columns will be printed.

As discussed previously, the largest or maximum shade value of any pixel in the current color canvas being printed may be less than the maximum shade value which is represented by the color data. For example, while 8-bit color pixel data allows for 256 shades (0–255) or a maximum shade value of 255, the maximum shade value or maximum optical density occurring on the current color canvas might be 99 or some other value less than 255. The maximum number of possible color shades, for the current color canvas, nshades, is one plus the maximum shade value of the current color canvas. Thus the value of nshades is determined by evaluating the 8-bit color data for the current color canvas to determine the maximum 8-bit color data value for the current color canvas.

In a preferred embodiment of the present invention, the maximum number of possible color shade values within a given color canvas will be normalized to a configured maximum shade value based on the maximum number of shades which the printer is configured to print. For example, an eight bit color pixel value may contain a shade value from 0–255. This value will be normalized based on the maximum number of shades for which the printer is configured to print. For example if the printer is configured to print 128 shades of color, the eight bit color pixel value will be divided by two to reach the 128 shades of color which the printer is capable of printing. This will increase print rate as the number of clock cycles for printing each shade is reduced accordingly in half. This example would result in nshades being reduced in half as well since the 8-bit color pixel data representing the maximum shade value would also be reduced in half.

The time to print each shade, tper shade, is dependent on the clock rate. For example, if a 8 MHz clock is used and there are 704 individual print elements on the printer with two ports or channels for inputting data to the printer, tper shade is 8 MHz×704/2 or 44 microseconds ($\mu$s). It will be appreciated that this will vary from printer to printer.

The overhead time processing constant K can be determined in a number of ways. In a preferred embodiment of the present invention, K is set to 5% of the time to print each shade, tper shade, which in this case would be 2 $\mu$s. It might also be set to a fixed value such as 2 $\mu$s.

In operation, once the color canvas shade values have been normalized, the color canvas color pixel data will be scanned for the maximum shade value. This value plus the configured number of preheat cycles will be passed to control logic for determination of the print rate as noted above. The calculated speed will be compared against a preset maximum print speed to prevent the print speed from overrunning the base processing requirement time.

In one embodiment of the present invention, there is provided the ability to specify different print voltage levels for each canvas type, e.g., color and monochrome canvases=1-bit per pixel, tonal canvases=8-bits per pixel, and topcoat layers=1-bit per pixel. Accordingly, the print voltage can be adjusted to accommodate the energy lost by printing lower shade counts. The maximum shade count may also be lowered and the print voltage raised to take advantage of the increased print speed.

It is to be understood, that even though numerous characteristics and advantages of the invention have been set forth in the foregoing description, together with details of the structure and function of the invention, the disclosure is illustrative only, and changes may be made in detail, especially in matters of shape, size, and arrangement of the parts within the principles of the invention to the full extent indicated by the broad general meaning of the terms in which the appended claims are expressed.

What is claimed is:

1. A variable speed print apparatus, comprising:

a thermal print head;

a transport system for moving a substrate to be printed on with one more color canvases comprising one or more print shades that are represented by a predetermined number, the predetermined number comprising a maximum number of print shades for each color canvas to be printed; and a control processor operatively interconnected to the thermal print head and the transport system for controlling a print rate of the variable speed print apparatus by varying the rate at which the transport system moves the substrate generally according to the maximum number of print shades for a current color canvas being printed, thereby optimizing the print rate of the variable speed print apparatus for the current color canvas being printed.

2. An apparatus in accordance with claim 1, wherein the following algorithm is utilized to determine the print rate:

Print Rate=tpreheat shades+(nshades * tper shade)+K where:

Print Rate=the print rate of the thermal printer:

tpreheat shades=time for preheat cycles;

nshades=the maximum number of possible print shades for the current color canvas;

tper shade=time per print shade (clock rate); and

K=overhead time processing constant.

3. An apparatus in accordance with claim 1, wherein the control processor includes a logic for adjusting the print rate for each color canvas per work piece being printed on.

4. An apparatus in accordance with claim 1, wherein the control processor includes a logic for adjusting the print rate for each color canvas per print line.

5. An apparatus in accordance with claim 1, wherein the control processor includes a logic for skipping a print line when no printing is to be done on the line.

6. An apparatus in accordance with claim 1, wherein shade values within the current color canvas being printed are normalized based on the maximum number of print shades for which the printer is configured to print.

7. A method for varying the speed of thermal printing, comprising the steps of:

determining a time for preheat cycles, tpreheat shades;

determining a maximum number of print shades for a current color canvas, nshades;

determining a time per print shade, tper shade;

determining a overhead time constant, K; and determining a print rate according to:

Print Rate=tpreheat shades+(nshades * tper shade)+K where:

Print Rate=the print rate of the thermal printer;

tpreheat shades=time for preheat cycles;

nshades=the maximum number of print shades for the current color canvas;

tper shade=time per print shade (clock rate); and

K=overhead time processing constant.

8. A variable speed print apparatus, comprising:

a thermal print head;

a transport system for moving a substrate to be printed on with one more color canvases comprising one or more print shades that are represented by a predetermined number, the predetermined number comprising a maximum number of print shades for each color canvas to be printed; and a control processor operatively interconnected to the thermal print head and the transport system for controlling a print rate of the variable speed print apparatus by varying the rate at which the transport system moves the substrate generally according to the maximum number of print shades for a current color canvas being printed and wherein the following algorithm is utilized to determine the print rate:

Print Rate=tpreheat shades+(nshades * tper shade)+K where:

Print Rate=the print rate of the thermal printer;

tpreheat shades=time for preheat cycles;

nshades=the maximum number of print shades for the current color canvas;

tper shade=time per print shade (clock rate); and

K=overhead time processing constant.

* * * * *